US005822874A

United States Patent [19]

Nemes

[11] Patent Number: 5,822,874

[45] Date of Patent: Oct. 20, 1998

[54] AUTOMATICALLY RETRACTING CHALK LINE MARKING TOOL

[76] Inventor: Anne Nemes, 2216 Richter Dr., Palm Harbor, Fla. 34683

[21] Appl. No.: 743,238

[22] Filed: Nov. 5, 1996

Related U.S. Application Data

[60] Provisional application No. 60/016,471, Apr. 29, 1996.

[51] Int. Cl.[6] ..... B44D 3/38

[52] U.S. Cl. ..... 33/414; 33/413

[58] Field of Search ..... 33/414, 413, 755, 33/756, 761, 767, 769; 242/381, 381.5, 371, 381.6, 385, 385.2, 385.3, 385.4, 394, 396, 396.1

[56] References Cited

U.S. PATENT DOCUMENTS

| | | | |
|---|---|---|---|
| 1,168,851 | 1/1916 | Carter | 33/414 |
| 1,208,068 | 12/1916 | Winchell . | |
| 3,888,010 | 6/1975 | Hyde et al. | 33/414 |
| 4,192,078 | 3/1980 | Lore et al. | 33/414 |
| 4,197,656 | 4/1980 | Lane et al. | 33/414 |
| 4,565,011 | 1/1986 | Karger | 33/414 |
| 4,592,148 | 6/1986 | Longnette | 33/414 |
| 4,765,557 | 8/1988 | Kahmann | 33/414 |
| 4,813,145 | 3/1989 | Josey, Jr. et al. | 33/414 |
| 5,042,159 | 8/1991 | Millen | 33/414 |
| 5,444,919 | 8/1995 | Alves | 33/414 |
| 5,509,616 | 4/1996 | Millen, Jr. et al. | 242/381.5 |
| 5,657,551 | 8/1997 | Lin | 33/767 |

*Primary Examiner*—Christopher W. Fulton
*Attorney, Agent, or Firm*—David Kiewit

[57] ABSTRACT

A pistol-shaped automatically retracting chalk-line dispenser comprises a three-member housing enclosing two separate chambers. The upper, chalk-receiving chamber, contains a double-walled chalk-line spool and a line-guiding roller. A seal on the chalk-line spool shaft prevents chalk dust from entering the second chamber, which contains drive gears, the line-retracting spring, and a trigger-actuated latching brake mechanism. In one embodiment, a finger-like projection from the trigger is initially brought to bear on a rotating cap to brake the rate of line retraction as the trigger is pulled rearwardly. If the trigger is pulled back more than a predetermined distance, the finger-like projection snaps into engagement between the teeth of a sprocket attached to the cap and thus locks the retraction mechanism.

15 Claims, 5 Drawing Sheets

AUTOMATICALLY RETRACTING CHALK LINE MARKING TOOL

CROSS REFERENCE TO RELATED APPLICATIONS

This application contains material previously filed in a Provisional Application for Patent number 60/016,471, filed on Apr. 29, 1996.

STATEMENT REGARDING FEDERALLY SPONSORED RESEARCH OR DEVELOPMENT

Not Applicable

BACKGROUND OF THE INVENTION

1. Field of the Invention

The invention relates to automatically retracting chalk-line dispensers comprising a housing containing both a reel for line storage and a chamber for storing chalk dust used to coat the line.

2. Description of Prior Art

The number of chalk line marking devices on the market is extensive with variations spanning the better part of the century. Devices of this sort are used by carpenters, bricklayers, roofers, sheet rock installers, flooring installers, interior decorators, and other artisans to mark straight lines over lengthy, rough or irregular surfaces The means by which this is generally done is awkward, and the endless rewinding after each use is both agonizing and time consuming. Also, the operation of these past devices requires the use of two hands.

An automatically retracting chalk line dispenser would eliminate such inconveniences. In creating such a device, however, the following considerations must be provided for: all parts must be economical, easily manufactured and assembled; and the device itself must be practical, easy to use, and efficient. Previous attempts of creating the ideal automatically retractable chalk line employ the same principle of enclosing a spool of line of some sort in a housing where the line is coated with chalk and passes outwardly through a small hole in the housing. While previous automatically retracting chalk line dispensers successfully retract a length of line, they also include certain drawbacks.

One goal of the invention is to prevent the chalk dust from seeping into the retraction assembly which would result in clogging the assembly and interfering with the retraction of the line. Devices described in U.S. Pat. Nos. 4,813,145; 4,765,557; and 1,208,068, issued to Millen, Jr. et al; to Josey, Jr. et al; to Kahmann; and to Winchell respectively, for example, include a housing forming one chamber containing the chalk dust and the retraction assembly. While the possibility of penetration of the chalk dust was reduced by measures taken, it was not eliminated.

Other examples, described in U.S. Pat. Nos. 5,042,159; 4,592,148; 4,565,011; 4,197,656; and issued to Millen Jr.; to Longenette; to Karger; and to Lane et al, respectively, include a housing enclosing two separate chambers. None of these teach a means for effectively sealing the chalk dust in the chalk chamber. Therefore the possibility of the dust seeping through the shaft aperture along the shaft still exists.

The devices described in U.S. Pat. Nos. 5,444,919, and 4,192,078, issued to Alves, and Lore et al., respectively, are also comprised of two separate chambers, however, they include washers to prevent leakage. Alves includes two ring-like washers; one in the opening in the adjoining wall between the two chambers and the other in the line aperture. The motor supplies enough force to draw the line through the two washers, but continuous use would wear the line and the washers to where chalk would be drawn back into the second chamber with each retraction. Lore et al., utilize a washer installed on the spool shaft and wedged between a notch in the shaft and the upper wall of the chalk chamber. This would be effective for a time, but the constant rotation and vibration of the spinning spool would cause the washer to wear after a time, and eventually cause leakage.

Another critical consideration is the length of the spring required to retract a sufficient length of line. Retraction of fifty-feet of line, for example, requires approximately two-hundred revolutions of a standard spool. The Longenette, Lore et al., and Winchell devices include no means of reducing the number of revolutions required. The Millen, and Karger devices include a gear arrangement which results in only a slight reduction in revolutions. The spools included in the Millen, Jr.; et al Josey, Jr. et al, and Kahmann devices are equipped with a recess in which the spring is disposed. The diameter of these spool walls are therefore larger than that of a standard spool and serve to decrease the number of revolutions necessary. However, even a fifty-percent decrease still results in a costly spring.

Other considerations can be viewed from a user's standpoint; some of which are as follows: Devices designed to fit in the palm of the user's hand such as the aforementioned examples, and others that utilize one chamber which includes the spool, retraction and breaking assemblies, will hold only a small supply of chalk. This would result in causing the user to stop his work frequently to refill the device. The Millen, Josey, and Longenette devices include no means to keep the chalk from leaking through the line aperture. The Winchell device includes no means of locking the retraction action of the spring when a portion of the chalk line is withdrawn from the device.

The Lore et al. device is designed to allow only a portion of line from the spool to be used due to the limitation set forth by the length of the spring. The Karger device overcomes the aforementioned problem of limited length of useable line by employing a retraction system whereby the spring can be disengaged in order to allow a further length of line to be withdrawn from the device after the length of spring has been wound to its utmost. Karger also teaches that the spring inside the cap is capable of rewinding only a predetermined length of line, after which the cap must be manually rotated to apply internal tension to the spring. Once fully tensioned the spring can be released to retract another predetermined length of line. This procedure is to be repeated until the entire length of line is withdrawn.

The Millen, Jr. device includes a centrifugal speed regulator which presets the retraction speed instead of allowing the user to choose his or her own. It and the Millen device also include a friction braking system applied against the line. This would result in considerable wear, and eventual breaking of the line. These devices, as well as the Josey, Kahmann, Longenette, and Karger devices do not allow for easy replacement of the spool and line.

All in all, the aforementioned disadvantages can out weigh the advantages of an automatically retracting device.

SUMMARY OF THE INVENTION

An automatically retracting chalk-line dispenser of the invention includes a three-member housing which, when joined together, encloses two separate chambers. The upper chamber, or chalk receiving chamber, receives powdered chalk through a closable door at the breech of the chamber. The chamber also contains a spool wound with line, a tapered roller which guides the line outwardly and back through the chamber, and a pair of wiping pads to remove excess chalk from the line.

When used, all or a portion of the line is withdrawn through an aperture in the upper portion of the housing. During the withdrawal, the spool, which is mounted on the output shaft portion of the pinion component, rotates in a counterclockwise direction as viewed looking downward from the top of the assembly. This action causes the input shaft portion of the gear component to rotate in a clockwise direction, thereby tensioning the enclosed spring. Once the desired length of line has been withdrawn, the line is locked in place by depressing the lower half of the trigger-shaped lever located in the handle-shaped portion of the housing. A newly designed hook, provided at the loose end of the line, allows for quick and easy placement on any structure.

Once the line has been snapped, the hook is removed from the structure and the line is retracted by depressing the upper half of the trigger. The speed of retraction can be regulated by applying pressure to the lower half of the trigger during retraction.

The overall design of the housing provides a pistol-grip configuration that allows the device to fit comfortably in the palm of the hand without restricting the chalk supply. This configuration also allows finger-tip operation of the device's functions.

The side members of the housing enclose the lower half of the chalk chamber, and a lower chamber which contains the retraction assembly. The side members may be joined together with rivets, self-tapping, one-way screws, or other fasteners which would eliminate the possibility of anyone tampering with the enclosed mechanism. Alternately, an adhesive may be used to seal the side members, an approach that would eliminate the need for screw holes or extra bosses in the housing. When joined with the side members (e.g., by means of a single screw) the uppermost member ,or cover, of the housing completes the enclosure of the chalk chamber. Pockets are provided on either of the interior side walls of the cover which allows the installation of a spring metal clip. A recess, located between the wiping pads and the line aperture is also included to catch any excess chalk or debris from the line during retraction.

The efficiency of the inventive device is enhanced by the combination of a spool having a second, wider, outer wall and a gear arrangement. This combination reduces the length of spring necessary by approximately ninety percent This enables the device to operate with a shorter spring than other prior devices, making the device practical and less costly to manufacture. It also reduces the diameter of the handle portion of the housing so that it can be held comfortably in the palm of the hand. The outer wall of the spool includes openings so that the chalk may penetrate the spool, thereby bathing the line from the inside as well as the outside.

An improved slotted hook provided with the device includes a pluglike end and a hole therein where the loose end of the line is attached. This serves to stop the chalk from leaking out of the line aperture. This plug also allows the hook to be held in place at the end of the housing for easier placement on a nail or other protruding pin. Further, barbs have been included on either side of the hook which allow it to be hooked back onto the line for easy placement around a protruding post or column.

The tapered roller is held in place in a cutout between adjoining side members and serves to guide the line to the center of the spool during retraction of the line. Also, the roller bore serves to guide the screw from the top of the housing through the chamber when it is threaded into the tapped hole located in the floor of the chalk chamber.

A spring metal clip, which may be installed in a left or right pocket located in the upper housing, is provided with the apparatus of the invention. This clip enables the user to carry the device on his/her belt while working.

The chalk door is in a position where the user can open or close the door without changing his or her grip on the device.

The pinion component consists of a pinion gear with a coaxially protruding shaft. The uppermost section is rounded and serves as a stub axle and end bearing for the component. Immediately below the axle is a square section upon which the spool is mounted. The lower section of the shaft includes two flanges separated by a length of circular shaft. The first, smaller flange serves as a detent for the spool. The section of shaft between the two flanges is equipped to receive a washer which prevents the chalk dust from leaking into the second chamber. The second, larger flange holds the pinion component in place within the adjoining wall of the two side members of the housing, and rotates therein. The length of shaft below the second flange sets the pinion in position in the lower chamber to connect to the spur gear.

The gear component comprises a spur gear with a axle protruding coaxially on one side. On the other side of the gear, which is also aligned coaxially, is a length of shaft equal in diameter to the axle portion. Immediately below this section is another shorter length of shaft that has a non-circular, and preferably hexagonal, cross-section. The shaft below the gear is slotted to receive the inner end of the spring. The hexagonal end of the shaft fits into a receiving opening in a brake component, thereby completing the assembly of the retraction mechanism.

The brake component may comprise a sprocket with a hexagonal-shaped cavity centrally located therein, a coaxially aligned inverted dome-shaped section, and a small axle protruding from the lower end of the dome.

A fulcrum lever, or trigger, is located in the lower portion of the housing and works in combination with a latching brake component. The trigger pivots on a post provided in the housing and allows the user finger-tip control of the retraction of the line. Once a desired length of line has been withdrawn, the line may be locked in place by applying pressure to the lower half of the trigger, which compels a hook-like projection to catch onto the sprocket portion of the latching brake component. To release the line, the user has only to depress the upper portion of the lever. A small spring adjacent to a finger-like protrusion at the uppermost point of the trigger holds it in the "release" position. Slight pressure on the lower half the trigger will cause the hooked end of the lever to contact the dome-like section of the brake component thereby dampening the speed of retraction.

The spring cartridge holds a pre-tensioned line-retracting spring, and through the means of a slit located on the wall of the cartridge, eliminates the need to mount the spring to the inner wall of the housing. It also allows assembly of the retraction mechanism to be accomplished outside the housing.

All components, except for the springs and belt clip, are moldable. The housing is to be constructed of a brightly colored high impact plastic material which makes the device highly visible, light in weight and durable.

Accordingly, besides the objects and advantages of the automatically retractable chalk line marking tool described hereinbefore, several objects and advantages of the present invention are to provide a device:

1. that allows the entire line to be withdrawn and retracted with no additional adjustments, or manual rewinding, 2. that requires no special or costly manufacturing processes, and can be marketed at a reasonable price;

3. that can be assembled easily to reduce the time and expense of manufacturing, 4. whose overall design is eye-catching to the consumer;

5. that includes enough line suitable for any commercial or residential application;

6. that includes an easily replaceable spool to store and dispense the line;

7. that allows the use of any brand of powdered chalk;

8. that includes a convenient belt clip which can be installed on either side to accommodate right or left-handed users;

9. that is of a compact and comfortable shape that allows one hand operation, and finger-tip control of its functions;

10. that does not require frequent refilling, 11. that is highly visible and of rugged construction.

12. that eliminates hand-cramping rewinding, 13. that is more efficient, and less fatiguing, especially on large commercial applications; and 14. that pays for itself in labor costs saved.

Our invention resides not in any one of these features per se, but rather in the particular combination of all of them herein disclosed and claimed and it is distinguished from prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily utilized as a basis for the designing of other structures, methods and systems for carrying out the purposes of the present invention. It is important, therefore, that the claims be regarded as including such equivalent constructions insofar as they do not depart from the spirit and scope of the present invention.

DESCRIPTION OF THE PREFERRED EMBODIMENT

The detailed description set forth below in connection with the appended drawings is intended as a description of the present invention equipped with a fifty-foot line. With variations in the size of the spool wall diameter, gear ratio and spring length, the device can be made to carry any length of line for use in other applications.

Experience teaches the draw-backs of attempting to snap a line over a length longer than fifty-feet. For example, when snapping a hundred-foot line over an irregular surface the line would only make contact with only the high points of the surface thus creating an erratic line. Another method would be to place several workers along the line to snap the line in sections. This would add considerably to labor costs and most likely create a distorted line. Another example would be in an application whereby the line is to be marked along a wall. It would be impossible to keep the line from sagging. Finally, it is not likely that the entire length of line withdrawn from the device would receive an even coating of chalk 11.

Figure 1:
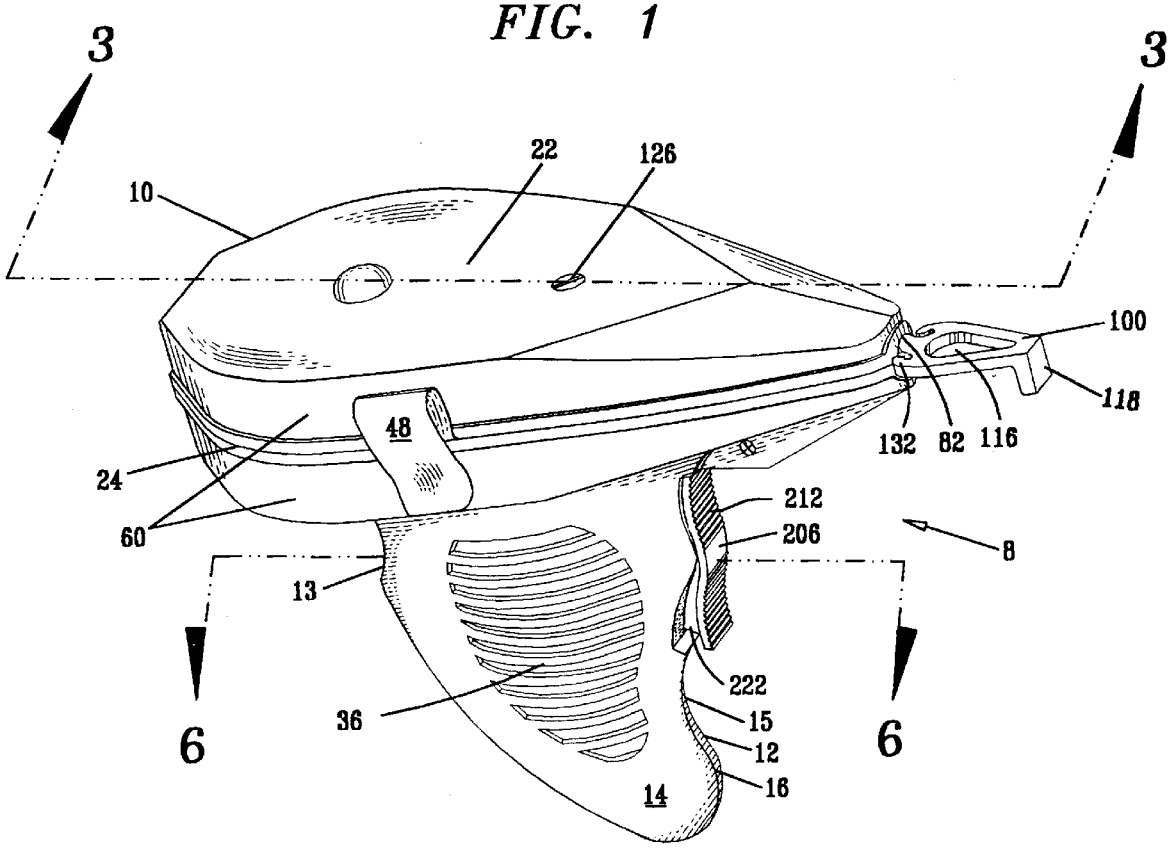
FIG. 1 is a perspective view of an apparatus of the invention.
Figure 3:
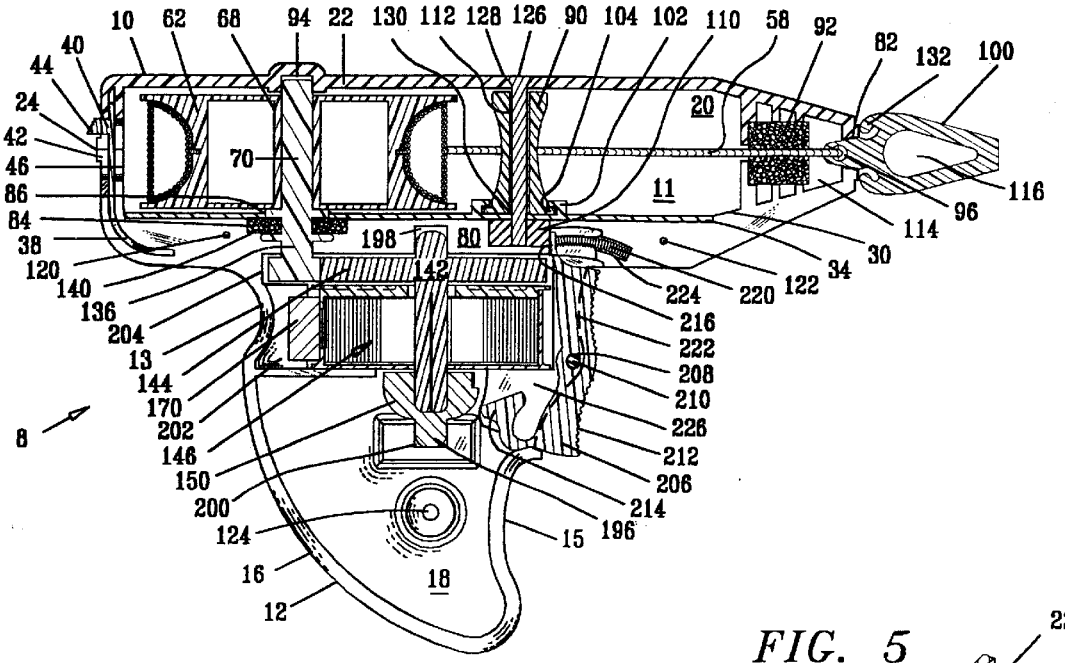
FIG. 3 is a cross-sectional view of the apparatus of FIG. 1, the vertical plane of section taken as shown by the double-headed dot-dash arrow labeled 3—3 in FIG. 1.

As shown, particularly in FIG. 1, a preferred retractable chalk line device of the invention 8 has a housing 10 configured in a generally pistol-like shape. A ribbed surface 36 on the face of the handle portion of the housing 10 is only one example of a method to achieve a gripping surface. The housing 10 is provided with an arched indentation 13 (FIG. 3) at the uppermost portion of the handle, and another 15 at the lower end so that the device may be held between the user's thumb, and his or her third and fourth fingers. This leaves the user's first and second fingers free to manipulate a trigger-like lever 206. The housing 10, as depicted in FIGS. 1 and 3, is comprised of three interfitting, or mating members; a left side 12, a right side 14, and a cover 22, all of which may be molded of a brightly colored, high-impact plastic.

Figure 4:
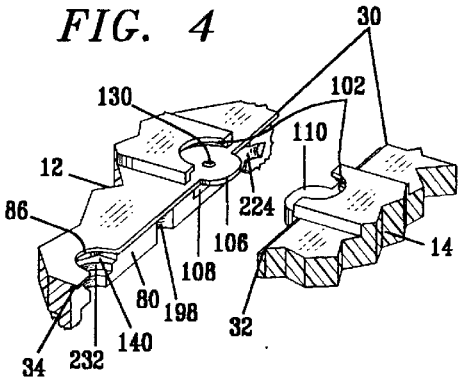
FIG. 4 is a cut-away elevational view of a portion of the side housing members at the mating line of the side members at the base of the chalk chamber.

Side members 12, 14 are peripherally joined along an upright U-shaped mating line 16 in the handle portion of the housing 10, and another 30 (FIGS. 3 and 4), extending from the breech, along an adjoining wall 80 which separates an upper, chalk-receiving chamber 20 and a lower, line-retracting spring 18 chamber, and ending at a line aperture 82 at the-opposite end.

The side members 12, 14 may be joined together by means of three rivets, one-way self-tapping screws, or other fasteners. Two holes 120, 122 are provided at either end of adjoining wall 80. A third hole 124 is positioned centrally within lower chamber 18. Members 12 and 14 are sealed to protect the enclosed mechanism against tampering.

Figure 5:
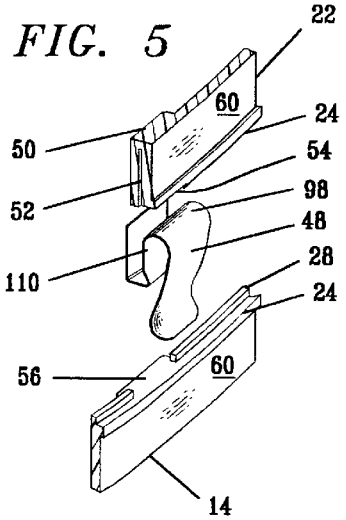
FIG. 5 is a cut-away cross-sectional view of a portion of the cover and right side member of the housing.

The uppermost member, or cover 22 (FIG. 3), of the housing 10 is peripherally joined with the side members 12, 14 along a longitudinally extending mating line 24 (FIG. 1). The mating surface (not shown) of the cover 22 is undercut, and the surface of the joined side members 12,14 are provided with a cooperating projection 28 particularly shown in FIG. 5. Referring now to mating line 30 along the floor of the chalk receiving chamber 20 shown in FIG. 4, left side member 12 is equipped with a projecting edge 34 which interlocks with the undercut edge 32 of right side member 14. The left side member 12 also includes a flange 106 which projects outwardly from a tap hole 130. Coaxially aligned below flange 106 is a semicircular cavity 108 which receives a reciprocal projection 110 from the right side member 14. Therefore, mating surfaces 24, and 30 form an interfitted rabbeted seal well suited for preventing leakage of chalk 11 from the chamber 20.

The cover 22 is preferably secured to the side members 12,14 by means of a single screw 126 inserted through an opening 128 (FIG. 3) in the cover 22 and threaded through a tap hole 130 located in the floor of the chalk chamber 20.

The housing 10, comprising the three members 12, 14, 22, consists of a chalk receiving chamber 20 (FIG. 3), and a lower, handle-like, chamber 18. Also, housing 10 forms a line aperture 82 at the front, and a circular chalk inlet port, or opening 42 at the breech of the upper portion of the housing 10 which is in communication with the interior of the chalk receiving chamber 20. Additionally, the housing 10 also encloses a suitably configured channel 38 adapted to receive a slidable door 40. When the door 40 is in the upright position (as shown), the port is closed and the chalk is contained within the chamber 20. The open position is achieved by compelling the door downward through a channel 38 by means of a projection 44, thereby revealing an opening in the housing wall 46.

Furthermore, the cover 22 is preferably equipped with a pocket 50 (FIG. 5) on either of the interior side walls of the chalk receiving chamber 20. A cutout 54 runs normal from a pocket opening 52 to mating line 24 on exterior wall 60. To prevent the chalk 11 from leaking through cutout 54 each side member 12, 14 is equipped with a cooperating projection 56 which seals off the pocket from the interior of the chamber 20. The pockets 50 allow the installation of an independent spring metal clip 48 which enables the user to carry the device on his or her person. Clip 48 is designed so that the back part 110 of the loop 98 presses against exterior wall 60 of the housing 10 thereby holding the clip 48 in place when the cover 22 is removed. The choice of pockets 50 is designed to accommodate left and right-handed users.

Along with a supply of chalk 11, the upper chamber 20 contains a unique double-walled spool 62 (FIG. 3), with a length of line 58 wound thereon. An important feature of the spool 62 is an empty space or void 63 radially intermediate the outer wall 64 on which the line 58 is wound and a spool shaft 72 over which the spool 62 is slid and with which the spool rotates. The oversized diameter of the outer wall 64, particularly indicated in FIG. 7, reduces the number of revolutions necessary to retract the full length of line 58 by at least fifty-percent. A key-hole slot 66 placed in each quadrant of the spool wall allows the chalk dust to penetrate the spool wall 64, thereby bathing both sides of the line 58. Moreover, it may be noted that these slots 66 are only one method that can be utilized. Any number of patterns of slots, holes, or the like will do equally well as long as they do not compromise the wall structure of the spool 62. The inner wall 68 of the spool 62 slips over a spool shaft portion 72 of a pinion component 70 to be described in greater detail hereinafter. The spool 62 can easily be replaced by removing the cover 22 and the screw 126.

A chalk line 58 extends outwardly from the spool 62 over a tapered line-guiding roller 90 which guides the line 58 to the center of the spool 62 during retraction. The roller 90 rotates in place by means of a flange 104 situated at its base which is inserted into a cutout 102 (FIG. 4) at the mating line 30 of the side members 12, 14. A bore 112 (FIG. 3) in the roller serves to guide the cover screw 126 from an opening 128 in the upper portion of the cover 22 through the chamber 20 and into tap hole 130, so that the roller 90 rotates about the axis of the cover screw 126.

The line 58 continues outwardly between a pair of wiping pads 92, and finally through an aperture 82. The wiping pads 92, (which may also be a single pad with a slit through the center), are formed of a highly compressible material which applies a slight tension to the line 58 in order to prevent the removal of too much chalk 11. A recess 114 in the housing between the wiping pads 92, and the aperture 82 is also provided to catch any excess chalk, dirt or debris from the returning line 58.

Figure 2:
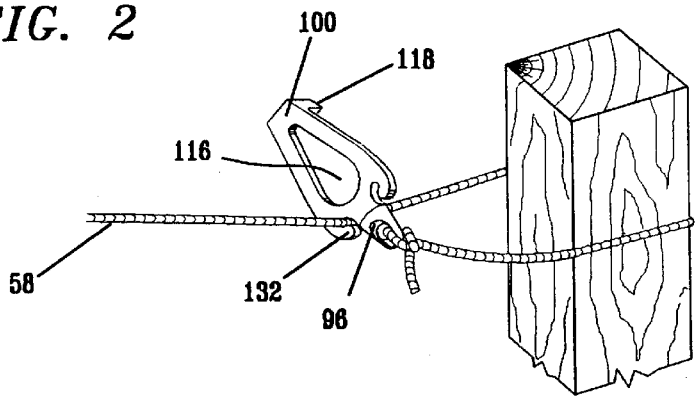
FIG. 2 is a perspective view depicting the hook component included in the present invention.

The loose end of the line 58 is threaded through a hole in a plug-like end 96 of a hook 100 (FIGS. 2, 3). The plug 96 is held in place within a frustum-shaped aperture 82 by the tension in the line 58, which affords the user easy placement of the hook 100 by several means. The hook 100, which can also be molded of plastic, is provided with a slot 116 which easily slips over any protruding pin. A perpendicular projection 118 at the end of the hook enables it to be held against the edge of any structure. Finally, a set of barbs 132 have been included so that the line 58 may be secured around any post or pillar as pictured in FIG. 2.

During operation of the present invention, all or a portion of the line 58 is withdrawn from the device either by first securing the hook 100 to some structure and then moving back with the device, or by grasping the hook 100 by hand and placing it on some structure a distance away from the device. The withdrawal of the line 58 causes the spool 62, which is mounted on a pinion component 70, to rotate in a counterclockwise direction.

Figure 7:
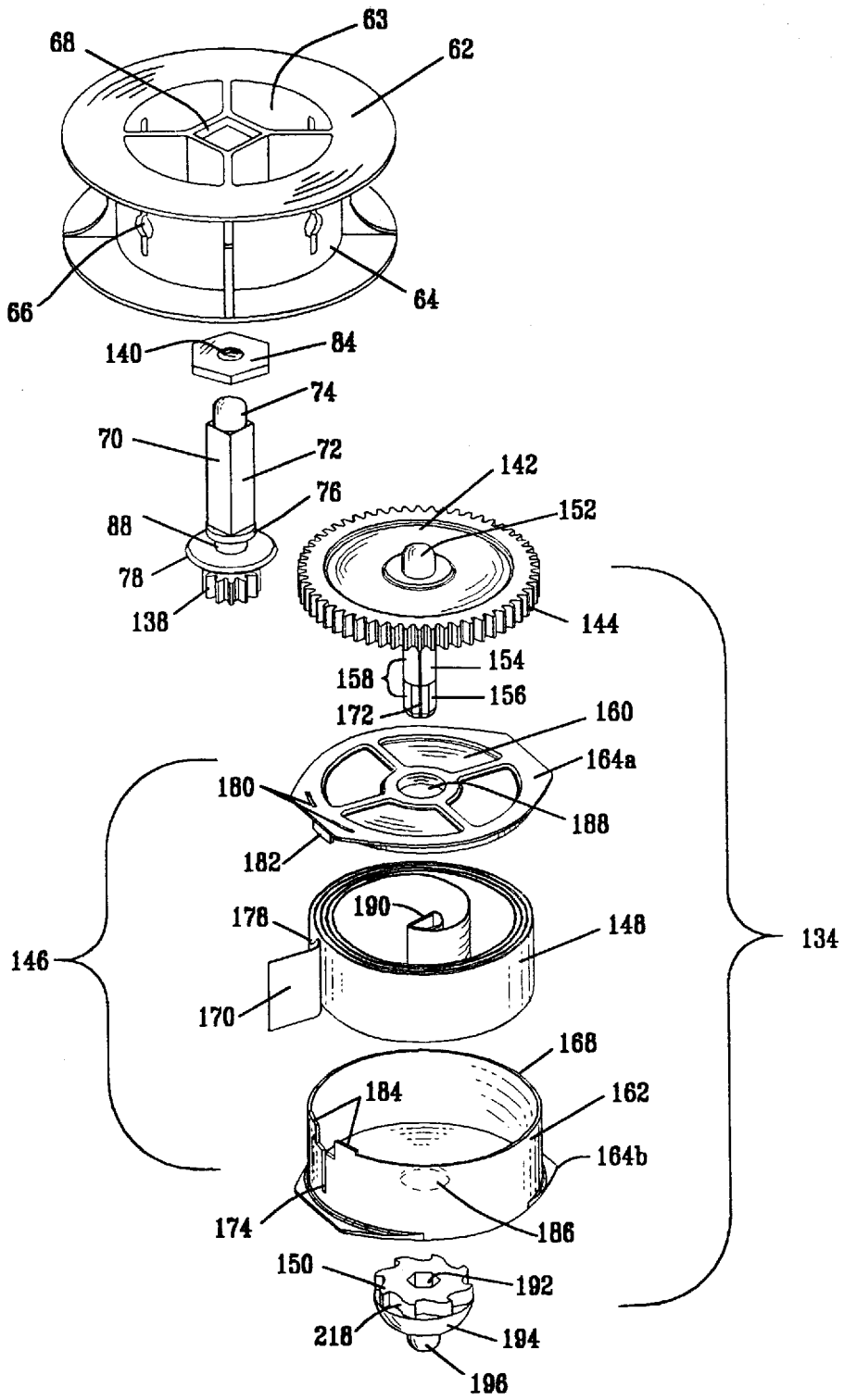
FIG. 7 is an exploded perspective view of selected internal components of the apparatus of the invention.

Referring now to FIG. 7, the pinion component 70 is equipped with a short axle-like bearing end 74 which is journaled for rotation within a cylindrical cavity 94 (FIG. 3) centrally located in the underside of the cover 22. Adjacent the bearing end 74 (FIG. 7) is a square spool shaft section 72 which fits within the inner wall 68 of the spool 62 so that the spool 62 and the pinion component 70 rotate together. Next are two flanges 76, 78 separated by a length of cylindrical shaft 88 coaxially aligned with the shaft, and then another length of cylindrical shaft 136 (FIG. 3) that is followed by a pinion gear 138. The mating surface 80 of each side member 12,14 is equipped with a series of cooperating openings 232 (see FIG. 4) to receive the section of the pinion component 70 from the midpoint of the flange 76 to the lower section of cylindrical shaft 136 just above the pinion gear 138.

The first, smaller, flange 76 protrudes slightly through an opening 86 in an adjoining wall 80 into the chalk receiving chamber 20 and serves as a detent for the spool 62. A portion of the cylindrical shaft 88 lying between the two flanges 76,78 accommodates the installation of a hexagonal-shaped washer 84 which creates a seal in the adjoining wall, and prevents the chalk 11 from seeping into the lower chamber 18. A washer 84 is formed of a compressible foam-like material which, once installed, forms itself to shaft 88, and to the interior of a cooperating seal-receiving recessed portion 140 of the housing wall. During operation, the washer 84 remains stationary while the pinion component 70 rotates within it The hexagonal-shaped opening 140 supports the washer 84 in such a way as to prevent wear by the rotating pinion component 70. The length of shaft below the second flange 78 sets the pinion gear 138 in position to connect with a spur drive gear 144 in a retraction assembly 134. The retraction assembly 134 comprises a drive gear component 142, a spring cartridge 146 having a spirally-wound line-retracting, or drive, spring 148 disposed therein, and a latching brake member 150. The drive spring 148 preferably has a central tab 190 formed at its first end, which is at the center of the spiral, and an outer, or retaining, tab 170 formed at the end of the spring 148 that is at the outer circumference of the spiral. It will be understood to those skilled in the art that although a spring cartridge 146 is preferred, many similar arrangements employing a known flat, spiral-wound line-retracting spring 148 coupled to an axle 156 having an axis coincident with or parallel to an axis of a chalkline spool 62 could also be employed.

Referring now to FIG. 7, gear component 142 consists of a spur gear 144 with an axle 152 protruding from the center on one side, and a cylindrical-shaped shaft 154 coaxially aligned on the other. Following shaft 154 is a length of hexagonal-shaped shaft 156. A slot 172 which runs from the upper portion of cylindrical shaft section 154 down through hexagonal-shaped section 156 of the shaft is also provided.

Spring cartridge 146 includes a cover 160 and a base 162, each of which is equipped with a flange 164, giving the cartridge 146 a generally truncated oval shape which keeps the cartridge 146 stationary within the lower chamber 18 of the housing 10. Power drive spring 148 is equipped with two notches 178 (only the upper notch is shown), near its outer circumferential end 170. The spring 148 is enclosed within a cylindrical wall 168 of the cartridge 146 and has its outer circumferential end 170 extending outwardly through a cutout, or slot 174 provided in the cylindrical wall 168.

The cover 160 is equipped with two slots 180 located on either side of a tab 182 which projects perpendicularly from the under side of a flange 164*a*. The arc of the slots 180, and tab 182 coincides with the diameter of the base wall 168. Once installed, the upper edge of the base wall 168 butts up against the cover flange 164*a*, and cover slots 180 receive twin tabs 184 positioned on either side of slot 174 provided on the base wall 168. Further, the cover tab 182 completes the base slot 174, thereby locking the distal end of the spring 170 in place, which eliminates the need to anchor the spring 148 to the housing 10.

The retraction mechanism is assembled by inserting the shaft 158 of the gear component through a cover opening 188, whereby shaft slot 172 receives the innermore end 190 of the spring 148. The shaft then continues on through the spring cartridge 146 by means of an opening in the base 186. Finally, the hexagonal-shaped end 156 of the shaft is inserted into a cooperating opening 192 centrally located on the face of the latching brake component 150.

The retraction assembly is enclosed within the side members 12,14 of the housing 10 by means of a series of coaxially aligned connecting openings of varying diameters 204. The gear component axle 152, and an end bearing portion 196 of the latching brake component 194 rotate within an opening 198 (FIG. 3) in the adjoining wall 80, and an opening or recessed portion 200 in the lower chamber 18, respectively. Further, the left side member 12 includes a spring-retaining recessed portion 202 accommodating a locking tab 170 formed on the outer end of the drive spring 148, i.e., the end distal from the axle 154.

Continuing now with the operation of the present invention, the counterclockwise rotation of pinion gear 138 causes a clockwise rotation of gear component 142 thereby tensioning the enclosed spring 148. Once the desired length of line 58 has been withdrawn it can be locked in place by means of the trigger-like lever 206 used in combination with the latching brake component 150. This combination also allows the user to release the line 58 as well as to regulate the speed of retraction. The trigger 206 is in the general shape of a "T" as shown, particularly in FIG. 6. The trigger face 212 follows the contour of the outer housing while a narrower inner section 222, which projects perpendicularly from the trigger face 212 is enclosed within cooperating slots 228,230, in the side members 12,14. Referring now to FIG. 3, the inner section 222 of the trigger 206 is equipped with a centrally located opening 208 which allows it to pivot on a post 210 provided in the left side member 12. The post 210 is received by a cooperating opening (not shown) in the right side member 14 thereby locking the trigger in place between the two side members 12,14. The trigger face 212 is contoured and knurled to afford the user better control.

Figure 6:
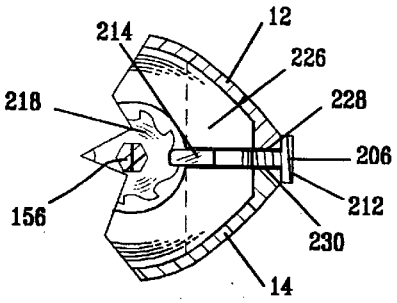
FIG. 6 is a partial cross-sectional view taken along the line 6—6 of FIG. 1, the view depicting a portion of the braking assembly.
Figure 8:
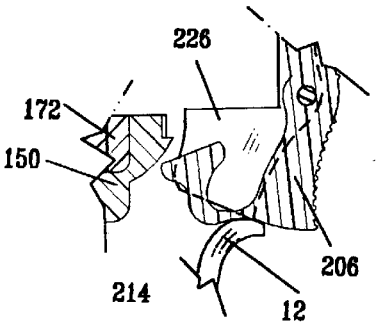
FIG. 8 is a partial cross-sectional view of the trigger in the "release" position, the plane of section being the same as that of FIG. 3.
Figure 9:
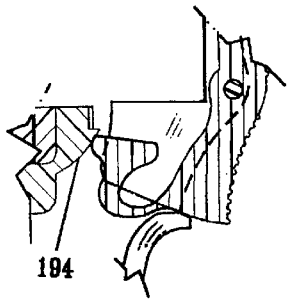
FIG. 9 is a partial cross-sectional view of the trigger in the braking position, the plane of section being the same as that of FIG. 3.
Figure 10:
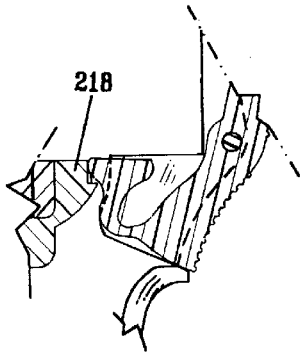
FIG. 10 is a partial cross-sectional view of the trigger in the locked position, the plane of section being the same as that of FIG. 3.

The uppermost end of the inner section 222 of the trigger 206 protrudes into a finger-like projection 216 which is in contact with a coil return spring 220. The coil spring 220 is enclosed within cavities 224 in the side member 12,14, and biases the trigger 206 into the "release" position (as depicted in FIG. 8). This position allows the latching brake component 150 to rotate freely, thereby creating tension on the line 58 and holding the hook 100 in place within the aperture 82. The lower end of the trigger's inner section 222 is equipped with a flexible hook-like projection 214. During retraction the user may control the speed of the returning line 58 by applying pressure to the lower half of the trigger face 212. This causes the rounded distal end of the hook-like projection 214 to contact a frictional surface 194 of the latching brake component 150, thereby dampening the normal speed of rotation (e.g., as depicted in FIG. 9). The frictional surface 194 is generally smooth surface of rotation that, in the preferred embodiment, is hemispherical in shape, although it will be understood that other surfaces of rotation, such as a frusto-conical surface, could also be employed. To lock a length of line 58 in place once it has been withdrawn, the user has only to fully depress the lower half of the trigger face 212, which causes the hook-like projection 214 to flex so that it can slide over the dome-like portion 194 and snap into engagement between ones of the teeth of a sprocket 218, as depicted in FIGS. 6 and 10. Subsequent pressure on the upper portion of the trigger 206 causes the rounded distal end of the projection 214 to slide out of engagement with the sprocket 218 so as to allow the spring 148 to apply tension to the line 58. Further, an area 226 (FIGS. 3, 6) of each side member 12,14 extends inwardly towards the trigger's inner section to prevent the hook-like projection 214 from twisting during contact with the rotating latching brake component 150.

Finally, once the side members 12,14 are secured with all the components in place, the initial tension on the line 58 is achieved by rotating the spool 62 counterclockwise for three to four rotations, and locking the trigger 206. The cover 22 may then be joined to the side members, 12,14 and the device 10 is ready to be filled with chalk 11.

It is also noted that although the above-described arrangements of a double-walled spool 62 with the pinion component 70, trigger 206 and gear component 142 is preferred, alternate arrangements may be used.

Figure 11:
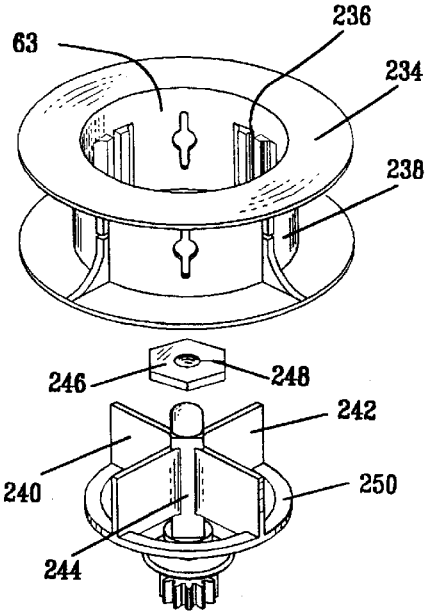
FIG. 11 is a perspective view of an alternate spool and pinion component.

Turning now to FIG. 11, one finds a spool 234 similar in configuration to the double-walled spool 62 described previously, and having a void 63 radially intermediate the outer wall 238 on which the line 58 is wound and a shaft 244 with which the spool 234 rotates. The inner wall 68, however, has been replaced with slots 236 incorporated into the wall 238. The cooperating pinion component 240 has spokes, or slats 242, projecting from the shaft 244. These slats 242 are received by the cooperating slots 236 of the spool 234. The ring-like structure 250 at the lower end of the slats 242 acts as a detent for the spool 234 and position it just above the floor of the chalk chamber 20. To complete the assembly, a washer 246 having a slit 248 is installed on the modified pinion component 240.

Figure 12:
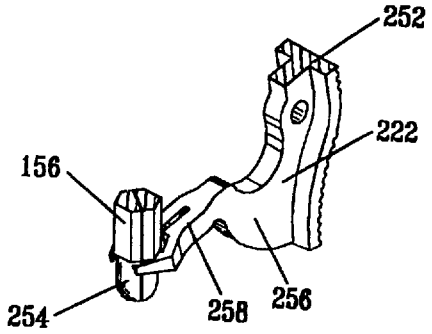
FIG. 12 is a cut away view of an alternate braking assembly in a release position.
Figure 13:
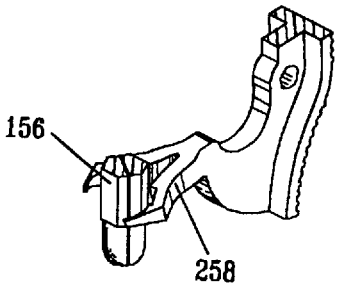
FIG. 13 is a cut away view of the alternate braking assembly in a braking position.
Figure 14:
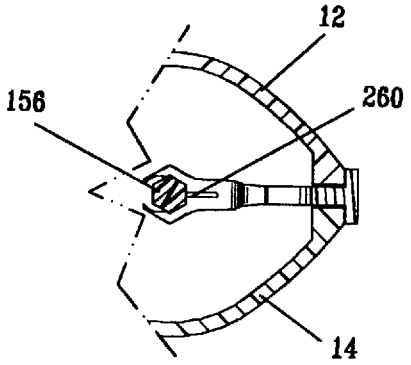
FIG. 14 is a partial cross-sectional view of the alternate braking assembly in a latched position, the plane of section corresponding to that of FIG. 6.

FIGS. 12, 13, and 14 depict an alternate trigger 252 having a release position (FIG. 12), a braking position for controlling the speed of retraction (FIG. 13), and having a latched position (FIG. 14). In this arrangement the trigger 252 engages the shaft 156 directly and does not use a separate latching brake component 150. Modifications consist of the addition of an axle 254 to the hexagonal end 156 of the gear component 142, and a change in the inner section 222 of the trigger 206. The flexible hook-like end 214 of the trigger 206 is replaced by a curved projection 256 which is bifurcated to form a deformable fork-like end 258.

This alternate trigger 252 operates similar to the trigger 206 described hereinbefore. Referring now FIG. 14, the bifurcation opening 260 has a non-circular, and preferably hexagonal, shape so that when the lower half of the trigger 252 is fully depressed, the bifurcated projection 256 snaps about and fully engages a corresponding non-circular and preferably hexagonal cross-sectioned portion 156 of the gear component 142, thereby locking the spool 62 in place. FIG. 12 depicts the alternate trigger 252 in the "release" position, wherein the upper half of the trigger 252 pivots the fork-like end 258 away from the shaft 156, which allows it to rotate freely. Intermediate the released and locked positions of the trigger 252, the fork-like end 258 deforms as it makes contact with the shaft 156, but does not fully enclose the shaft 156, whereby the frictional engagement of the shaft portion 156 by the projection 256 acts to brake the rotation of the spool 62

Although the present invention has been described with respect to several preferred embodiments, many modifications and alterations can be made without departing from the invention. Accordingly, it is intended that all such modifications and alterations be considered as within the spirit and scope of the invention as defined in the attached claims.

I claim:

1. An automatically retracting chalk-line dispenser comprising a housing; a chalk-line spool coupled to a first shaft for rotation therewith, the spool disposed in a chalk-receiving chamber; a line-retracting spring coupled to a second shaft; and a gear arrangement coupling the first shaft to the second shaft; the dispenser further comprising:

a shaft seal adjacent a wall of the chalk-receiving chamber, the first shaft adapted to rotate within the seal, the seal intermediate the spool and the spring; and a trigger attached to the housing for pivotal motion between a latched and a released position, a projection portion of the trigger coacting with the second shaft so as to prevent the second shaft from rotating when the trigger is in the latched position, the projection not coacting with the second shaft when the trigger is in the released position, the projection frictionally coacting with the second shaft so as to brake the rotation thereof when the trigger is intermediate the latched and the released positions.

2. The chalk-line dispenser of claim 1 further comprising a latching brake component fixedly attached to the second shaft adjacent an end of the second shaft distal from the spool, the latching brake component comprising a frictional surface and a sprocket having a plurality of teeth, wherein the projection comprises a flexible hook-like portion of the trigger, the flexible hook-like portion fitting between ones of the teeth when the trigger is in the latched position, the flexible hook-like portion bearing on the frictional surface when the trigger is intermediate the latched and the released positions.

3. The chalk-line dispenser of claim 1 wherein a portion of the second shaft distal from the spool has a non-circular cross-section, and wherein the trigger further comprises a bifurcated projection portion engaging that portion of the second shaft having the non-circular cross-section and thereby preventing rotation of the spool when the trigger is in the latched position, the bifurcated projection not engaging the second shaft when the trigger is in the released position, the bifurcated projection frictionally braking the rotation of the second shaft when the trigger is intermediate the latched and the released positions.

4. The chalk-line dispenser of claim 1 further comprising a return spring biasing the trigger into the released position.

5. The chalk-line dispenser of claim 1 wherein the gear arrangement comprises a spur gear attached to the second shaft, the spur gear drivingly engaged with a pinion gear attached to the first shaft at an end thereof distal from the spool.

6. An automatically retracting chalk-line dispenser comprising:

a first, chalk-receiving, chamber containing therein a chalk-line spool the first chamber adapted to receive therein chalk dust, the chalk line spool rotating with a spool shaft;

a spool shaft seal intermediate the chalk-receiving chamber and a second chamber containing therein a line-retracting spring, the spool shaft extending into the second chamber and journalled for rotation within the seal, the seal adapted to prevent chalk from coming into contact with the spring;

a pinion gear attached to a portion of the spool shaft within the second chamber, the pinion gear drivingly engaged with a spur gear attached to a second shaft, the second shaft driven by the line-retracting spring; and braking means movable between a braking position in which the braking means frictionally acts upon a portion of the second shaft distal from the spur gear, and a released position, in which the braking means does not frictionally act upon the second shaft.

7. The automatically retracting chalk-line dispenser of claim 6 further comprising a void intermediate a wall of the spool on which the line is wound and the spool shaft the void adapted to receive the chalk dust.

8. The automatically retracting chalk-line dispenser of claim 6 wherein the braking means comprises latching means acting to prevent the second shaft from rotating.

9. The automatically retracting chalk-line dispenser of claim 6 wherein the braking means comprises:

a trigger pivotally attached to a wall of the second chamber, the trigger comprising a flexible hook-like portion; and a latching brake component fixedly attached to the second shaft, the latching brake component comprising a frictional surface and a sprocket having a plurality of teeth, wherein the hook-like portion of the trigger does not touch the latching brake component when the braking means is in the released position, wherein the hook-like portion engages the frictional surface of the latching brake component when the braking means is in the braking position and wherein the hook-like portion fits between two of the teeth when the trigger is in a latched position.

10. The automatically retracting chalk-line dispenser of claim 6 wherein the spool shaft comprises first and second flanges, wherein first and second interfitting members are joined to define both the second chamber and a portion of the first chamber and wherein the seal comprises a compressible washer surrounding the spool shaft intermediate the two flanges and adjacent those portions of the first and second members that define a wall between the first and the second chambers.

11. The automatically retracting chalk-line dispenser of claim 6, flintier comprising a line-guiding roller disposed in the chalk-receiving chamber, the line-guiding roller rotating about a cover screw holding a cover member on the chalk-receiving chamber, the cover screw received in a portion of one of two interfitting members that are joined to define both the second chamber and a portion of the chalk-receiving chamber.

12. A chalk line dispenser comprising:

a spirally wound line-retracting spring having a first end at a center of the spiral and a second end at an outer circumference thereof, the line-retracting spring disposed in a cylindrical cartridge having a cylindrical wall with a slot therethrough, the second end of the spring extending outwardly through the slot;

a drive gear fixedly attached to a first shaft the first shaft engaging the first end of the line-retracting spring;

a pinion gear fixedly attached to a second shaft journaled for rotation within a seal, the pinion gear engaging the drive gear;

a chalk-line spool engaging the second shaft for rotation therewith;

a housing comprising a handle-like portion comprising a first chamber wherein the cartridge is disposed so that the second end of the spring engages a wall of the first chamber;

a second chamber wherein the spool is disposed; and means of retaining the seal about the second shaft intermediate the first and the second chambers.

13. In a chalk-line dispenser comprising a housing holding a chalk-line spool, the spool coupled to a line retracting spring by means comprising a shaft, an improvement comprising a latching brake, the latching brake comprising:

a first portion rotating with the shaft, the first portion having a non-circular cross-section; and a trigger attached to the housing for pivotal motion between a latched and a released position, the trigger comprising a flexible portion coacting with the first portion when the trigger is in the latched position, the flexible portion frictionally bearing on the first portion when the trigger is intermediate the latched and the released positions, the flexible portion not coacting with the first portion when the trigger is in the released position.

14. The chalk-line dispenser of claim 13 wherein:

the first portion of the latching brake comprises a latching brake component fixedly attached to the shaft, the latching brake component comprising a frictional surface and a sprocket having a plurality of teeth; and wherein the flexible portion of the trigger comprises a portion fitting between ones of the teeth of the sprocket when the trigger is in the latched position.

15. The chalk-line dispenser of claim 13 wherein the first portion of the latching brake comprises a portion of the shaft and wherein the flexible portion of the trigger comprises a bifurcated projection portion engaging the portion of the shaft having the non-circular cross-section and thereby preventing rotation of the drive gear when the trigger is in the latched position.

* * * * *

UNITED STATES PATENT AND TRADEMARK OFFICE

CERTIFICATE OF CORRECTION

PATENT NO. : 5,822,874
DATED : 10/20/98
INVENTOR(S) : Nemes

It is certified that error appears in the above-identified patent and that said Letters Patent is hereby corrected as shown below:

Claim 6, col. 12, line 37,
a comma was omitted after "chalk-line spool" and before "the first chamber".
Claim 7, col. 12, line 58,
a comma was omitted after "the spool shaft" and before "the void".
Claim 11, col. 13, line 21,
after "claim 6" the word "flintier" was substituted for "further".

Signed and Sealed this

Sixteenth Day of March, 1999

*Attest:*

*Attesting Officer*

Q. TODD DICKINSON

*Acting Commissioner of Patents and Trademarks*